US006196436B1

(12) United States Patent
Williams

(10) Patent No.: US 6,196,436 B1
(45) Date of Patent: Mar. 6, 2001

(54) UTILITY BAG SYSTEM

(76) Inventor: Rosa M. Williams, 2963 Canfield Ct. Apt. C, Ferguson, MO (US) 63136

( * ) Notice: Subject to any disclaimer, the term of this patent is extended or adjusted under 35 U.S.C. 154(b) by 0 days.

(21) Appl. No.: 09/405,709

(22) Filed: Sep. 24, 1999

(51) Int. Cl.[7] ..... A45C 13/30

(52) U.S. Cl. ..... 224/602; 224/581; 224/637; 224/639; 224/652; 224/660

(58) Field of Search ..... 224/575, 581, 224/602, 627, 637, 639, 640, 642, 643, 652, 660

(56) References Cited

U.S. PATENT DOCUMENTS

| | | | | |
|---|---|---|---|---|
| Re. 14,365 | * | 9/1917 | Danz, II | 224/660 |
| D. 265,696 | * | 8/1982 | Koszegi | D3/33 |
| 860,395 | * | 7/1907 | Lindsey | 224/660 X |
| 2,411,721 | * | 11/1946 | Hancock et al. | 224/660 X |
| 3,001,566 | | 9/1961 | Lipsitz . | |
| 4,369,526 | * | 1/1983 | Clutts | 2/51 |
| 5,040,524 | * | 8/1991 | Votel et al. | 2/305 X |
| 5,129,560 | * | 7/1992 | Herman | 224/660 X |
| 5,205,448 | * | 4/1993 | Kester et al. | 224/637 X |
| 5,292,042 | * | 3/1994 | Yamaguchi et al. | 224/159 |
| 5,540,364 | * | 7/1996 | Krieger et al. | 224/581 X |
| 5,577,653 | * | 11/1996 | Bieker | 224/660 X |

* cited by examiner

*Primary Examiner*—Stephen K. Cronin

(57) ABSTRACT

A utility bag system for holding items therein and wearing on the shoulders and around the waist of a user. The utility bag system includes a waist panel and a lower panel coupled thereto to form therebetween a spaced apart pair of side pockets and a middle pocket interposed between the side pockets with each pocket having an upper opening therein. A pair of elongate flexible shoulder straps each have a pair of opposite ends coupled to a top edge of the waist panel.

20 Claims, 2 Drawing Sheets

UTILITY BAG SYSTEM

BACKGROUND OF THE INVENTION

1. Field of the Invention

The present invention relates to utility bag systems and more particularly pertains to a new utility bag system for holding items therein and wearing on the shoulders and around the waist of a user.

2. Description of the Prior Art

The use of utility bag systems is known in the prior art. More specifically, utility bag systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,292,042; 5,129,560; 4,369,526; Des. 265,696; U.S. Pat. Nos. 3,001,566; and 2,411,721.

While these devices fulfill their respective, particular objectives and requirements, the aforementioned patents do not disclose a new utility bag system. The inventive device includes a waist panel and a lower panel coupled thereto to form therebetween a spaced apart pair of side pockets and a middle pocket interposed between the side pockets with each pocket having an upper opening therein. A pair of elongate flexible shoulder straps each have a pair of opposite ends coupled to a top edge of the waist panel.

In these respects, the utility bag system according to the present invention substantially departs from the conventional concepts and designs of the prior art, and in so doing provides an apparatus primarily developed for the purpose of holding items therein and wearing on the shoulders and around the waist of a user.

SUMMARY OF THE INVENTION

In view of the foregoing disadvantages inherent in the known types of utility bag systems now present in the prior art, the present invention provides a new utility bag system construction wherein the same can be utilized for holding items therein and wearing on the shoulders and around the waist of a user.

The general purpose of the present invention, which will be described subsequently in greater detail, is to provide a new utility bag system apparatus and method which has many of the advantages of the utility bag systems mentioned heretofore and many novel features that result in a new utility bag system which is not anticipated, rendered obvious, suggested, or even implied by any of the prior art utility bag systems, either alone or in any combination thereof.

To attain this, the present invention generally comprises a waist panel and a lower panel coupled thereto to form therebetween a spaced apart pair of side pockets and a middle pocket interposed between the side pockets with each pocket having an upper opening therein. A pair of elongate flexible shoulder straps each have a pair of opposite ends coupled to a top edge of the waist panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new utility bag system apparatus and method which has many of the advantages of the utility bag systems mentioned heretofore and many novel features that result in a new utility bag system which is not anticipated, rendered obvious, suggested, or even implied by any of the prior art utility bag systems, either alone or in any combination thereof.

It is another object of the present invention to provide a new utility bag system which may be easily and efficiently manufactured and marketed.

It is a further object of the present invention to provide a new utility bag system which is of a durable and reliable construction.

An even further object of the present invention is to provide a new utility bag system which is susceptible of a low cost of manufacture with regard to both materials and labor, and which accordingly is then susceptible of low prices of sale to the consuming public, thereby making such utility bag system economically available to the buying public.

Still yet another object of the present invention is to provide a new utility bag system which provides in the apparatuses and methods of the prior art some of the advantages thereof, while simultaneously overcoming some of the disadvantages normally associated therewith.

Still another object of the present invention is to provide a new utility bag system for holding items therein and wearing on the shoulders and around the waist of a user.

Yet another object of the present invention is to provide a new utility bag system which includes a waist panel and a lower panel coupled thereto to form therebetween a spaced apart pair of side pockets and a middle pocket interposed between the side pockets with each pocket having an upper opening therein. A pair of elongate flexible shoulder straps each have a pair of opposite ends coupled to a top edge of the waist panel.

Still yet another object of the present invention is to provide a new utility bag system that provides a hands-free means for holding items to a user in a manner that spreads the weight of the load to the shoulders and waist of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
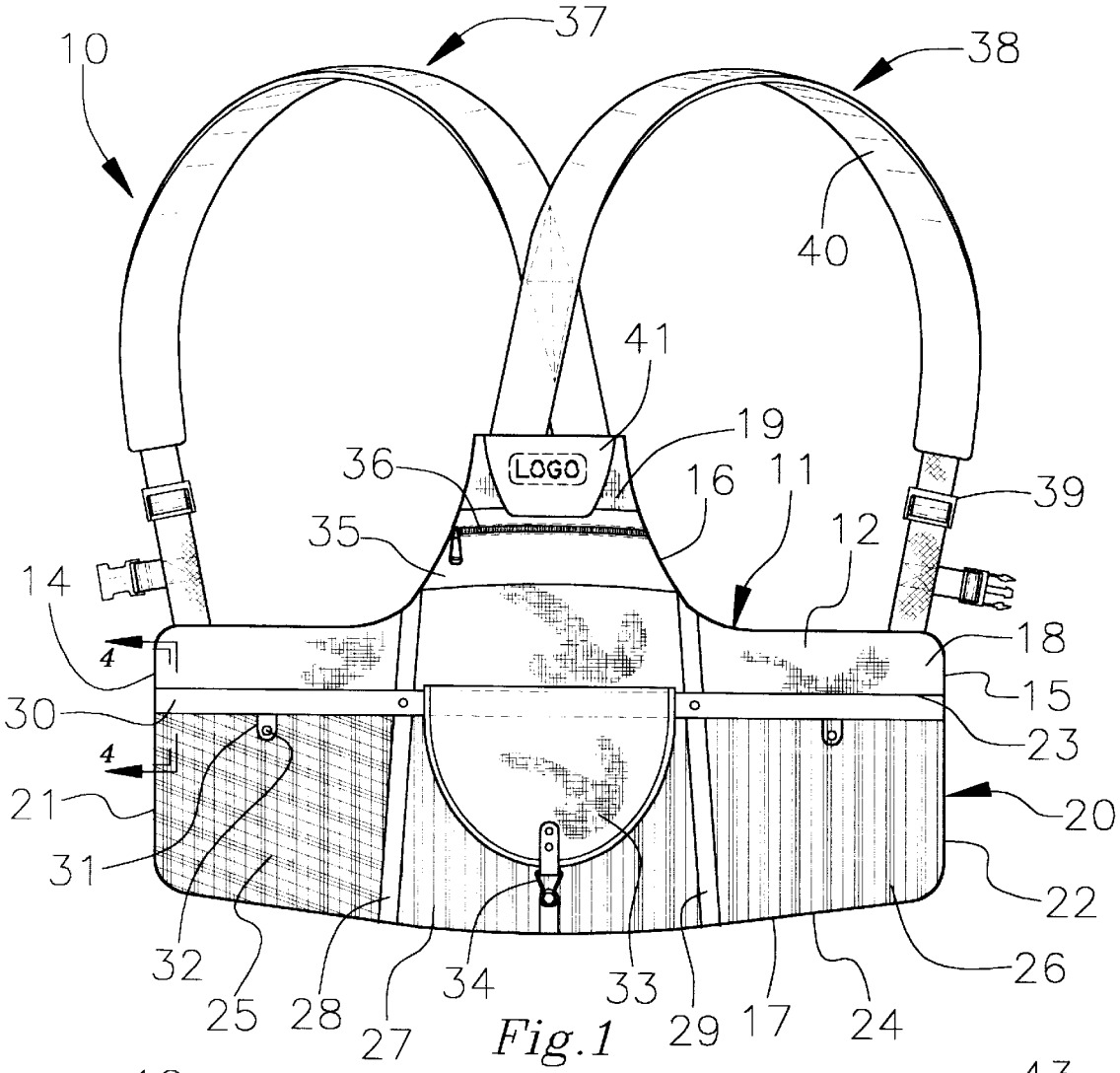
FIG. 1 is a schematic plan view of a new utility bag system according to the present invention.
Figure 4:
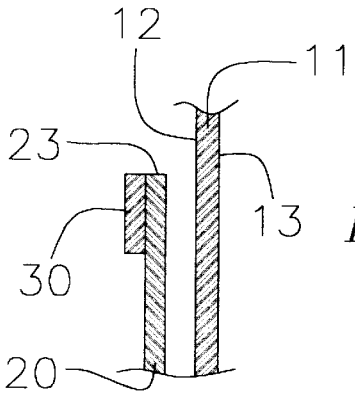
FIG. 4 is a schematic cross sectional view taken from line 4—4 of FIG. 1 representative of the pockets of the present invention.
Figure 2:
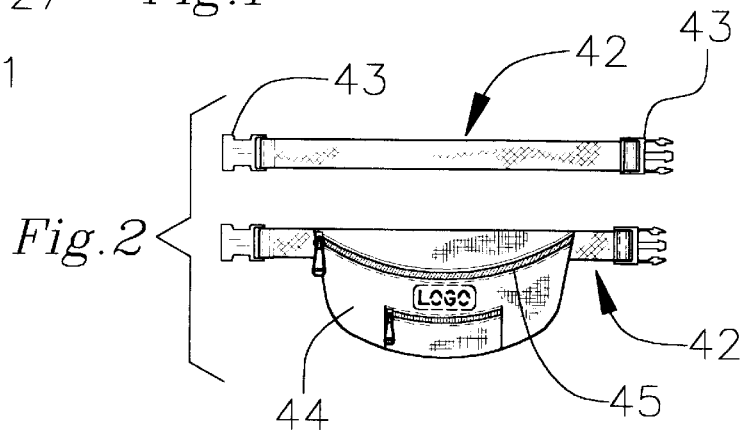
FIG. 2 is a schematic plan view of two embodiments of the front strap of the present invention.

With reference now to the drawings, and in particular to FIGS. 1 through 4 thereof, a new utility bag system embodying the principles and concepts of the present invention and generally designated by the reference numeral 10 will be described.

As best illustrated in FIGS. 1 through 4, the utility bag system 10 generally comprises a waist panel and a lower panel coupled thereto to form therebetween a spaced apart pair of side pockets and a middle pocket interposed between the side pockets with each pocket having an upper opening therein. A pair of elongate flexible shoulder straps each have a pair of opposite ends coupled to a top edge of the waist panel.

In closer detail, the utility bag system 10 comprises a generally inverted T-shaped flexible waist panel 11 having exterior and interior faces 12,13, a pair of end edges 14,15, top and bottom edges 16,17, a generally rectangular lower portion 18 and a generally trapezoidal central upper portion 19 upwardly extending from the lower portion of the waist panel at a central location generally equidistantly positioned between the end edges of the waist panel.

The system also includes a flexible lower panel 20 having a generally rectangular outer perimeter comprises a pair of end edges and top and bottom edges extending between the end edges of the lower panel. The lower panel is positioned adjacent the exterior face of the waist panel. The lower panel is coupled to the exterior face of the waist panel to form therebetween a spaced apart pair of side pockets 24,25 and a middle pocket 26 interposed between the side pockets. The top edge of the lower panel defines upper openings into the side and middle pockets.

In closer detail, the bottom edge of the lower panel coextensive with and coupled to the bottom edge of the waist panel, one of the end edges of the lower panel is coupled to the waist panel along one of the end edges of the waist panel and the other of the end edges of the lower panel is coupled to the waist panel along the other of the end edges of the waist panel. The lower panel is also coupled to the waist pocket between each side pocket and the middle pocket to form the side and middle pockets.

Preferably, a pair of elongate generally vertical longitudinal reinforcing strips 28,29 are coupled to the exterior face of the waist panel and to the lower panel. One of the longitudinal reinforcing strips is extended between the middle pocket and one of the side pockets. The other of the longitudinal reinforcing strips is extended between the middle pocket and the other of the side pockets. In use, the longitudinal reinforcing strips are designed for strengthening the couplings between the waist and lower panels forming the side and middle pockets.

Also included in this preferred embodiment is an outwardly facing elongate generally horizontal lateral reinforcing strip 30 which is coupled to the lower panel along the top edge of the lower panel. The lateral reinforcing strip is ideally extended over and coupled to the longitudinal reinforcing strips with generally circular headed fabric rivets. In use, the lateral reinforcing strip is designed for reinforcing the material around the upper openings of the side and middle pockets.

The side pockets ideally each have an outwardly facing flexible fob strap 31 coupled thereto adjacent the top edge of the lower panel. Each of the fob straps has a free end detachably attached preferably by a snap fastener 32 to the lower panel. In use, the fob straps are designed for looping items therethrough to secure the items to the lower panel.

A flexible cover flap 33 having a generally D-shaped outer perimeter is coupled to the exterior face of the middle pocket and folded over the lower panel to covering the upper opening of the middle pocket. The cover flap is detachably attached to the lower panel adjacent the bottom edge of the lower panel ideally by a loop and button fastener 34 comprising a loop portion preferably coupled to the cover flap and a button portion preferably coupled to the lower panel.

The exterior face of the waist panel also preferably has an upper pocket 35 in the upper portion of the waist panel. The upper pocket has a zippered slit 36 providing a closable opening into the upper pocket. In use, the side, middle, and upper pockets arc each designed for holding items therein.

Figure 3:
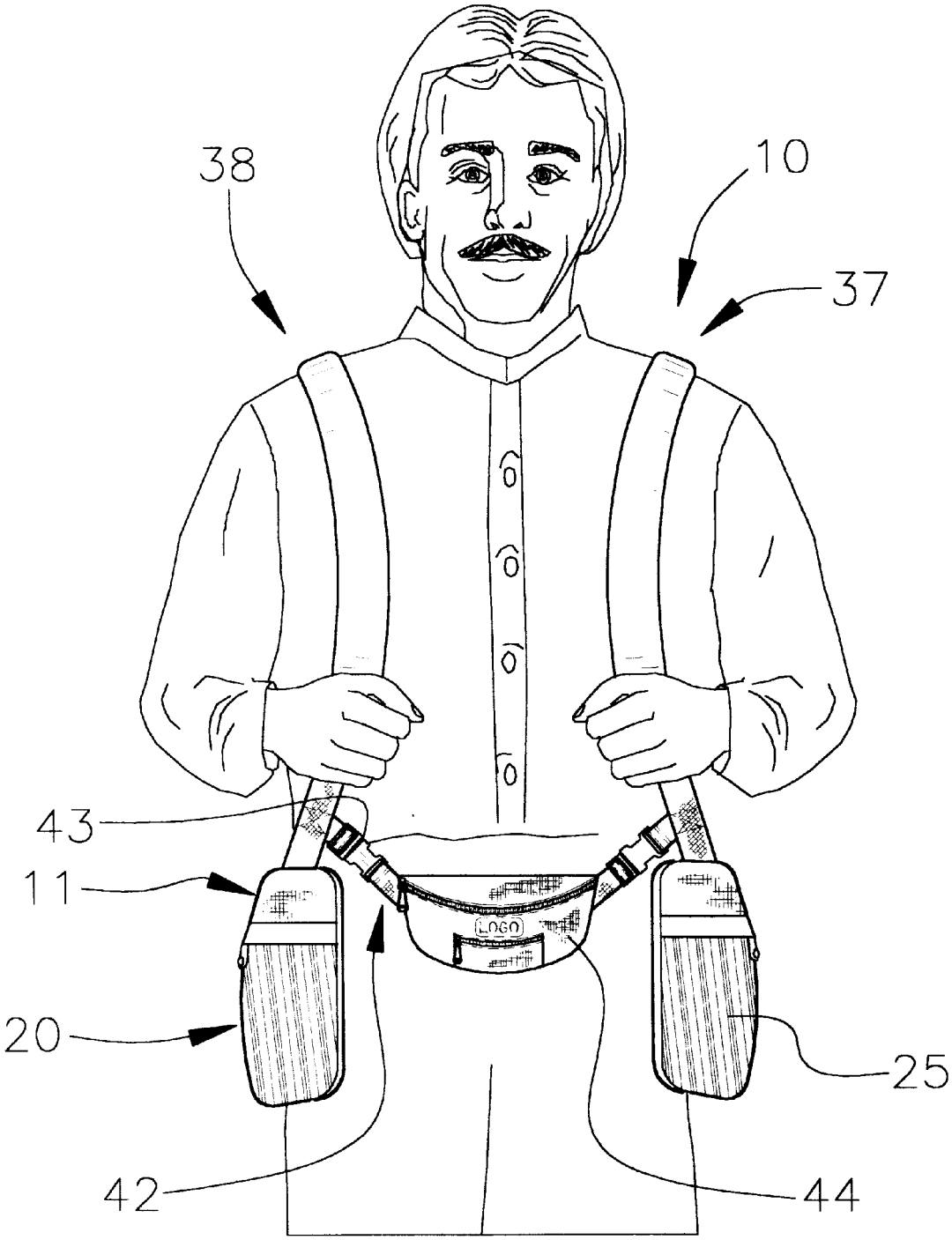
FIG. 3 is a schematic plan view of the present invention in use on a user.

The system also includes a pair of elongate flexible shoulder straps 37,38 each having a pair of opposite ends coupled to the top edge of the waist panel. In use, the shoulder straps are designed for hanging the utility bag system on the shoulders of a user as illustrated in FIG. 3 such that the waist panel is positioned behind the back of the user and so that the side pockets hang adjacent the sides of the user. Preferably, each shoulder strap is adjustable in length with adjustment buckles 39 and has padded upper regions 40 for providing additional comfort to the shoulders of a user.

A back end of the pair of ends of each shoulder strap is coupled to the top edge of the waist panel adjacent the upper portion of the waist panel. A generally trapezoidal reinforcing patch 41 is coupled to the back ends of the shoulder straps and the exterior face of the waist panel in the upper portion of the waist panel. Ideally, the reinforcing patch comprises a leather material. In use, the reinforcing patch is designed for helping reinforce the coupling between the back ends of the shoulder straps A front end of the pair of ends of one of the shoulder straps is coupled to the top edge of the waist panel adjacent one of the side edges of the waist panel. A front end of the pair of ends of the other of the shoulder straps is coupled to the top edge of the waist panel adjacent the other of the side edges of the waist panel.

In the preferred embodiment, an elongate flexible front strap 42 is provided having a pair of opposite ends. One of the ends of the front strap is detachably attached (preferably by a quick release fastener 43) to one of the shoulder straps adjacent the front end of the one shoulder strap. Similarly, the other of the ends of the front strap is detachably attached (also preferably by a quick release fastener) to the other of the shoulder straps adjacent the front end of the other shoulder strap. In use, the front strap are designed for positioning in front of the user as illustrated in FIG. 3.

In an ideal embodiment, a front pouch 44 is coupled to the front strap. The front pouch has a zippered slit 45 providing a closable opening into the front pouch. In use, the front pouch is designed for holding additional items therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A utility bag system, comprising:

a waist panel having exterior and interior faces, a pair of end edges, top and bottom edges, a lower portion and an upper portion upwardly extending from said lower portion of said waist panel;

a lower panel having an outer perimeter comprising a pair of end edges and top and bottom edges extending between said end edges of said lower panel;

said lower panel being coupled to said exterior face of said waist panel to form therebetween a spaced apart pair of side pockets and a middle pocket interposed between said side pockets, said top edge of said lower panel defining upper openings into said side and middle pockets;

a pair of elongate flexible shoulder straps each having a pair of opposite ends coupled to said top edge of said waist panel; and a pair of elongate longitudinal reinforcing strips being coupled to said exterior face of said waist panel and to said lower panel, one of said longitudinal reinforcing strips being extended between said middle pocket and one of said side pockets, the other of said longitudinal reinforcing strips being extended between said middle pocket and the other of said side pockets.

2. The utility bag system of claim 1, further comprising an outwardly facing elongate lateral reinforcing strip being coupled to said lower panel along said top edge of said lower panel.

3. The utility bag system of claim 1, wherein said side pockets each have an outwardly facing flexible fob strap coupled thereto adjacent said top edge of said lower panel, each of said fob straps having a free end detachably attached to said lower panel.

4. The utility bag system of claim 1, further comprising a flexible cover flap being coupled to said exterior face of said middle pocket and covering said upper opening of said middle pocket, said cover flap being detachably attached to said lower panel.

5. The utility bag system of claim 1, wherein said exterior face of said waist panel has an upper pocket in said upper portion of said waist panel, said upper pocket having a zippered slit providing a closable opening into said upper pocket.

6. The utility bag system of claim 1, further comprising an elongate flexible front strap having a pair of opposite ends, one of said ends of said front strap being detachably attached to one of said shoulder straps and the other of said ends of said front strap being detachably attached to the other of said shoulder straps.

7. The utility bag system of claim 6, further comprising a front pouch being coupled to said front strap, said front pouch having a zippered slit providing a closable opening into said front pouch.

8. A utility bag system, comprising:

a flexible waist panel having exterior and interior faces, a pair of end edges, top and bottom edges, a generally rectangular lower portion and a generally trapezoidal central upper portion upwardly extending from said lower portion of said waist panel at a central location generally equidistantly positioned between said end edges of said waist panel;

a flexible lower panel having a generally rectangular outer perimeter comprising a pair of end edges and top and bottom edges extending between said end edges of said lower panel;

said lower panel being positioned adjacent said exterior face of said waist panel;

said lower panel being coupled to said exterior face of said waist panel to form therebetween a spaced apart pair of side pockets and a middle pocket interposed between said side pockets, said top edge of said lower panel defining upper openings into said side and middle pockets;

a pair of elongate longitudinal reinforcing strips being coupled to said exterior face of said waist panel and to said lower panel;

one of said longitudinal reinforcing strips being extended between said middle pocket and one of said side pockets, the other of said longitudinal reinforcing strips being extended between said middle pocket and the other of said side pockets;

an outwardly facing elongate lateral reinforcing strip being coupled to said lower panel along said top edge of said lower panel;

said side pockets each having an outwardly facing flexible fob strap coupled thereto adjacent said top edge of said lower panel, each of said fob straps having a free end detachably attached to said lower panel;

a flexible cover flap being coupled to said exterior face of said middle pocket and covering said upper opening of said middle pocket;

said cover flap being detachably attached to said lower panel;

said exterior face of said waist panel having an upper pocket in said upper portion of said waist panel, said upper pocket having a zippered slit providing a closable opening into said upper pocket;

a pair of elongate flexible shoulder straps each having a pair of opposite ends coupled to said top edge of said waist panel;

a back end of said pair of ends of each shoulder strap being coupled to said top edge of said waist panel adjacent said upper portion of said waist panel;

a generally trapezoidal reinforcing patch being coupled to said back ends of said shoulder straps and said exterior face of said waist panel in said upper portion of said waist panel;

a front end of said pair of ends of one of said shoulder straps being coupled to said top edge of said waist panel adjacent one of said side edges of said waist panel;

a front end of said pair of ends of the other of said shoulder straps being coupled to said top edge of said waist panel adjacent the other of said side edges of said waist panel;

an elongate flexible front strap having a pair of opposite ends;

one of said ends of said front strap being detachably attached to one of said shoulder straps adjacent said front end of said one shoulder strap;

the other of said ends of said front strap being detachably attached to the other of said shoulder straps adjacent said front end of said other shoulder strap; and a front pouch being coupled to said front strap, said front pouch having a zippered slit providing a closable opening into said front pouch.

9. A utility bag system, comprising:

a waist panel having exterior and interior faces, a pair of end edges, top and bottom edges, a lower portion and an upper portion upwardly extending from said lower portion of said waist panel;

a lower panel having an outer perimeter comprising a pair of end edges and top and bottom edges extending between said end edges of said lower panel;

said lower panel being coupled to said exterior face of said waist panel to form therebetween a spaced apart pair of side pockets and a middle pocket interposed between said side pockets, said top edge of said lower panel defining upper openings into said side and middle pockets;

a pair of elongate flexible shoulder straps each having a pair of opposite ends coupled to said top edge of said waist panel; and wherein said side pockets each have an outwardly facing flexible fob strap coupled thereto adjacent said top edge of said lower panel, each of said fob straps having a free end detachably attached to said lower panel.

10. The utility bag system of claim 9, further comprising a flexible cover flap being coupled to said exterior face of said middle pocket and covering said upper opening of said middle pocket, said cover flap being detachably attached to said lower panel.

11. The utility bag system of claim 9, wherein said exterior face of said waist panel has an upper pocket in said upper portion of said waist panel, said upper pocket having a zippered slit providing a closable opening into said upper pocket.

12. The utility bag system of claim 9, further comprising an elongate flexible front strap having a pair of opposite ends, one of said ends of said front strap being detachably attached to one of said shoulder straps and the other of said ends of said front strap being detachably attached to the other of said shoulder straps.

13. The utility bag system of claim 12, further comprising a front pouch being coupled to said front strap, said front pouch having a zippered slit providing a closable opening into said front pouch.

14. A utility bag system, comprising:

a waist panel having exterior and interior faces, a pair of end edges, top and bottom edges, a lower portion and an upper portion upwardly extending from said lower portion of said waist panel;

a lower panel having an outer perimeter comprising a pair of end edges and top and bottom edges extending between said end edges of said lower panel;

said lower panel being coupled to said exterior face of said waist panel to form therebetween a spaced apart pair of side pockets and a middle pocket interposed between said side pockets, said top edge of said lower panel defining upper openings into said side and middle pockets;

a pair of elongate flexible shoulder straps each having a pair of opposite ends coupled to said top edge of said waist panel; and a flexible cover flap being coupled to said exterior face of said middle pocket and covering said upper opening of said middle pocket, said cover flap being detachably attached to said lower panel.

15. The utility bag system of claim 14, wherein said exterior face of said waist panel has an upper pocket in said upper portion of said waist panel, said upper pocket having a zippered slit providing a closable opening into said upper pocket.

16. The utility bag system of claim 14, further comprising an elongate flexible front strap having a pair of opposite ends, one of said ends of said front strap being detachably attached to one of said shoulder straps and the other of said ends of said front strap being detachably attached to the other of said shoulder straps.

17. The utility bag system of claim 16, further comprising a front pouch being coupled to said front strap, said front pouch having a zippered slit providing a closable opening into said front pouch.

18. A utility bag system, comprising:

a waist panel having exterior and interior faces, a pair of end edges, top and bottom edges, a lower portion and an upper portion upwardly extending from said lower portion of said waist panel;

a lower panel having an outer perimeter comprising a pair of end edges and top and bottom edges extending between said end edges of said lower panel;

said lower panel being coupled to said exterior face of said waist panel to form therebetween a spaced apart pair of side pockets and a middle pocket interposed between said side pockets, said top edge of said lower panel defining upper openings into said side and middle pockets;

a pair of elongate flexible shoulder straps each having a pair of opposite ends coupled to said top edge of said waist panel; and wherein said exterior face of said waist panel has an upper pocket in said upper portion of said waist panel, said upper pocket having a zippered slit providing a closable opening into said upper pocket.

19. A utility bag system, comprising:

a waist panel having exterior and interior faces, a pair of end edges, top and bottom edges, a lower portion and an upper portion upwardly extending from said lower portion of said waist panel;

a lower panel having an outer perimeter comprising a pair of end edges and top and bottom edges extending between said end edges of said lower panel;

said lower panel being coupled to said exterior face of said waist panel to form therebetween a spaced apart pair of side pockets and a middle pocket interposed between said side pockets, said top edge of said lower panel defining upper openings into said side and middle pockets;

a pair of elongate flexible shoulder straps each having a pair of opposite ends coupled to said top edge of said waist panel; and an elongate flexible front strap having a pair of opposite ends, one of said ends of said front strap being detachably attached to one of said shoulder straps and the other of said ends of said front strap being detachably attached to the other of said shoulder straps.

20. The utility bag system of claim 19, further comprising a front pouch being coupled to said front strap, said front pouch having a zippered slit providing a closable opening into said front pouch.

* * * * *